US010934732B2

(12) United States Patent
Reacer et al.

(10) Patent No.: US 10,934,732 B2
(45) Date of Patent: Mar. 2, 2021

(54) SWIMMING POOL CLEANING HEAD

(71) Applicants: William L. Reacer, La Mesa, CA (US); Hans Hamm, La Mesa, CA (US)

(72) Inventors: William L. Reacer, La Mesa, CA (US); Hans Hamm, La Mesa, CA (US)

( * ) Notice: Subject to any disclaimer, the term of this patent is extended or adjusted under 35 U.S.C. 154(b) by 0 days.

(21) Appl. No.: 16/056,544

(22) Filed: Aug. 7, 2018

(65) Prior Publication Data

US 2020/0048923 A1 Feb. 13, 2020

(51) Int. Cl.
*E04H 4/16* (2006.01)

(52) U.S. Cl.
CPC ..... *E04H 4/1636* (2013.01); *E04H 4/169* (2013.01)

(58) Field of Classification Search
CPC ..... E04H 4/1636; E04H 4/169
See application file for complete search history.

(56) References Cited

U.S. PATENT DOCUMENTS

| | | | | |
|---|---|---|---|---|
| 2,823,410 | A * | 2/1958 | Aleo | A47L 9/02 15/339 |
| 3,243,830 | A * | 4/1966 | Conrad | E04H 4/1636 15/1.7 |
| 3,360,816 | A * | 1/1968 | Fontecchio | E04H 4/1636 15/1.7 |
| 3,795,027 | A * | 3/1974 | Lindberg, Jr. | A47L 9/06 15/398 |
| 4,502,172 | A * | 3/1985 | Chandler | E04H 4/1636 15/1.7 |
| 8,296,891 | B1 * | 10/2012 | Rowam | E04H 4/1636 15/1.7 |
| 10,184,259 | B2 * | 1/2019 | Frankel | B63B 59/08 |
| 2011/0203980 | A1 * | 8/2011 | Dietrich | E04H 4/1636 210/167.17 |

* cited by examiner

*Primary Examiner* — Randall E Chin
(74) *Attorney, Agent, or Firm* — Harris Brotman

(57) ABSTRACT

A device for vacuuming debris from the bottom of a pool of water. The device comprises a housing which forms a frustoconical cavity having a mouth on the lower surface and an exit hole on the top of the frustoconical cavity. A hose is attached on one end to the exit hole and in fluid connection with a source of vacuum.

4 Claims, 1 Drawing Sheet

SWIMMING POOL CLEANING HEAD

FIELD OF THE INVENTION

The present invention relates to pool vacuum devices and, specifically, to a self-contained pool vacuum head including a submersible vacuum having a housing surrounding an interior thrust channel between a bottom open mouth and a top discharge opening for removing sediment and debris from the bottom of a tank such as a swimming pool.

BACKGROUND OF THE INVENTION

The ordinary care and maintenance of swimming pools requires regular vacuuming of the bottom to remove dirt, leaves, and other debris. A common pool vacuum system employs the use of an elongate flexible hose which attaches at one end to a vacuum head on a pole and to the pool's skimmer intake at an opposite end.

Upon activation of the pump of the pool's filter system, water is drawn through the skimmer intake creating a suction at the vacuum head. By maneuvering the vacuum head, using the pole, along the bottom pool surface, dirt and other debris is drawn through the hose and into the filter system. Larger debris, such as leaves, sticks, paper and the like is trapped in a basket in the filter system.

Typical vacuum heads are rectangular and flat with a 1.5 inch exit port hole in the center, with two sets of wheels, usually four in front and four in back, or two in front and two in back.

Debris is forced to enter the vacuum head by traversing a 90 degree angle from the surface of the pool into the mouth, gathering up in clumps creating clog further down the line. Furthermore, the hydrodynamics of the vacuum is such that leaves stick to the side of the walls of the inner surface.

Commercial pool cleaning services, which typically clean from between 20 to 40 pools per day, prefer not to use the above-described vacuuming method, as it is somewhat laborious and time-consuming. In recent years, many commercial pool services have begun using self-contained submersible vacuum heads which attach to the end of a convention aluminum pole. The vacuum head plugs into an electric power source to energize a motor mounted within the vacuum head. The motor drives a propeller which creates a thrust through the vacuum head, drawing dirt, leaves, and other debris through the vacuum head and into an attached catch bag. Once the pool has been vacuumed, the vacuum head is lifted and removed from the pool and the catch bag is detached and cleaned. Use of such submersible vacuum heads has proven to be cost-effective and efficient to many commercial pool cleaning services.

SUMMARY

The present invention provides a vacuum head having a housing which is hydrodynamically designed to eliminate flow dead spaces on the inner surface of the housing. This has been achieved by providing a frustoconical cavity comprising a mouth at one end having a lip formed as a tangential surface congruent with the inner surface that rises from the mouth up to the exit hole.

DETAILED DESCRIPTION OF INVENTION

Figure 2:
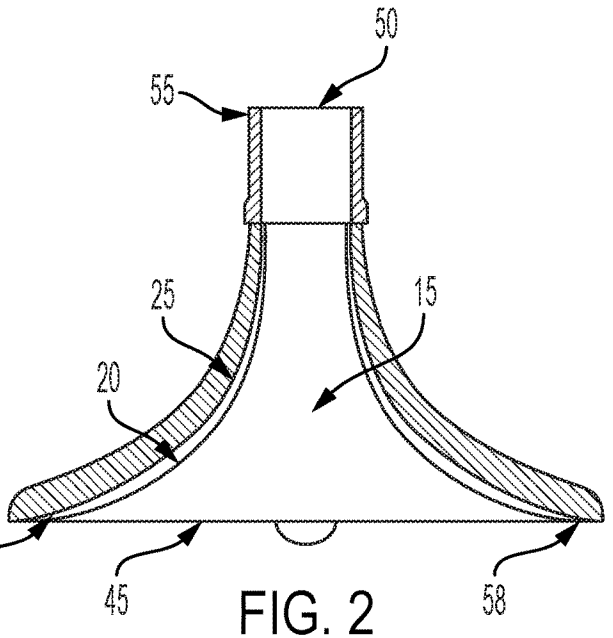
FIG. 2 is a cross section profile of the funnel shaped interior cavity of the vacuum head along 2-2 of FIG. 1.
Figure 1:
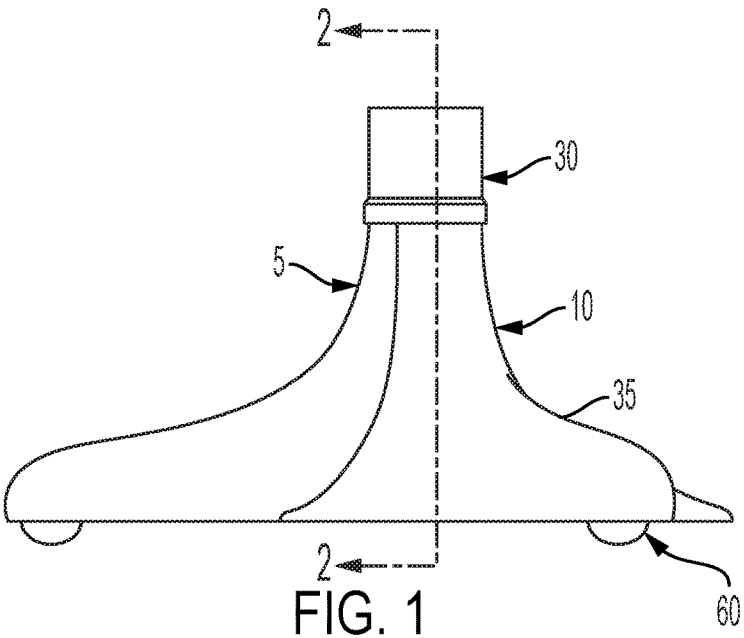
FIG. 1 is side elevational view of a preferred form of the unit embodying the present invention.
Figure 3:
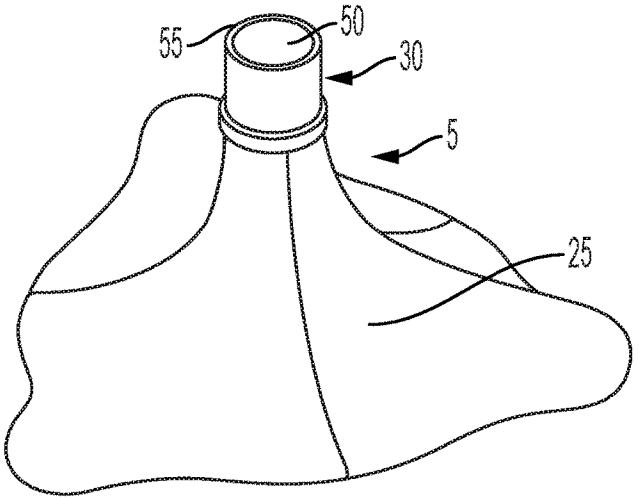
FIG. 3 is a planar elevational view of the unit shown in FIG. 1.

The present invention comprises a pool cleaner vacuum head 5 comprising a body 10 defining a frusto-conical cavity 15 having an inner surface 20, and outer surface 25, a top portion 30 and a bottom portion 35.

The edge 40 at the bottom portion defines a mouth 45 for said cavity which engages the surface being cleaned. The diameter of the mouth is approximately eight inches. The mouth diameter can range from six inches to as big as eighteen inches. In an embodiment of the device, three wheels 60 are positioned on the bottom surface in a triangular pattern. Other embodiments have up to six wheels positioned in variable arrangements The wheels form roller means 60 extending below the mouth edge for engagement with under water surface being cleaned. Such wheels support the vacuum head so that the open bottom, the mouth, thereof runs adjacent but in clearance relation to such surface. A preferred clearance is about 0.75 inches. The roller means permit movement and maneuverability of said vacuum head along a surface within the body of water so that the vacuum mouth is maintained at a predetermined distance relative to the surface.

In an embodiment, the outer surfaces comprises attachment means for an elongate pole. For example, a yoke on the outer surface of the housing is structured for removable attachment of the elongate pole thereto so that said housing can be manipulated within the body of water.

The interior surface 20 or sides of the frusto-conically shaped cavity of the vacuum head rises to an approximately 1.5 inch exit port or hole 50. Debris enters the mouth at the tangentially formed lip 58 of the mouth. The lip is shaped in a continuous curve congruent with the inner surface up to the exit port.

The lip is shaped with a tangent angle which forms a smooth arc of continuous curvature from the bottom of the vacuum mouth to the top of the exit hole 50, the discharge opening. Optimal shapes for use in the invention control the rate of curvature change from the bottom to the top of the inner surface of the vacuum head. Arcs that find use in the present invention include any curvature continuous curve such as Bezier curve, B-spline, and/or parabolic curves.

The debris flows upward along the inner surface, thereby allowing debris to enter the vacuum head with less restriction and flow upwards. The tangentially shaped lip 58 in relation to the inner surface minimizes dead space (flow separation) along the inner surface. Because debris doesn't have to make a 90 degree turn into an eight-inch diameter hole, there is less clogging, and longer pieces of debris goes up with ease. Also, because of the funnel shape, debris is shuttled in alignment on the interior surface rather than gathering up in clumps creating clogs further down the line.

At the bottom end of the funnel is an open circular vacuum mouth 45 rimmed by a tangentially shaped lip 58 from which rises the inner surface of the cavity defining a thrust channel extending from said open elongate vacuum mouth to said discharge opening. The upper exit hole is a discharge opening tangent at a top surrounded by an annular rim 55. A negative pressure at said vacuum mouth creates a suction force sufficient to pull water and debris through said vacuum mouth and said thrust channel and out from said discharge opening into said hose. The other end of the hose is placed in fluid confluence with the skimmer line of the existing pool system, which acts as a vacuum or a source of negative pressure. The upper end of said frustoconical interior chamber terminates in an open discharge port of the vacuum head, In operation, the vacuum motivated fluid draws pool debris from the bottom of the pool into the vacuum head and up through the discharge hole into the hose. Powerful upward water flow will thrust and lift leaves, debris and trash from the bottom of the pool upwardly through a said frusto-conical section of the cavity and into an exit hole to which is detachably mounted a hose, at the other end of the hose, pool debris exits and is deposited into the basket of the skimmer.

In operation, one provides the device having a plurality of wheels thereon so that the vacuum head can be rolled about in the swimming pool, the vacuum head being configured to have a mouth, i.e. suction opening at a bottom portion thereof proximate a surface of the swimming pool creating an upward flow of water through the vacuum head in response to negative pressure transmitted from the skimmer of said pool through said hose and through said cavity such that debris is removed from the bottom of the swimming pool while moving the pool vacuum head around the swimming pool. In effect, the debris collected by the device is deposited in the skimmer.

The device can be formed of metal, plastic or combinations thereof, manufacturing details to be determined by engineer.

What is claimed is:

1. A device comprising:

a. vacuum head housing having a top portion and a bottom portion wherein the interior surface of said vacuum head forms a frusto-conical cavity the interior surface of said cavity defined by a smooth arc of continuous curvature;

b. said bottom portion has a lower edge forming a lip having a periphery further wherein the periphery of said lower edge of the lip is formed in an unobstructed, continuous curve;

c. said top portion an exit hole formed therein for detachable fluid communication with a hose in fluid communication with a vacuum source wherein said vacuum source is a pool skimmer.

2. The device of claim 1 comprising roller means attached to the bottom portion of said housing.

3. The device of claim 2 wherein said roller means comprises one or more wheels.

4. The device of claim 1 wherein the top portion comprises a yoke adjacent to said exit hole, said yoke being structured for removable attachment of an elongate pole thereto so that said housing can be manipulated within a body of water.

* * * * *